United States Patent [19]

Howitt

[11] 4,051,789

[45] Oct. 4, 1977

[54] WALL FIXTURE

[75] Inventor: Robert T. Howitt, Leominster, Mass.

[73] Assignee: Frem Corporation, Worcester, Mass.

[21] Appl. No.: 707,669

[22] Filed: July 22, 1976

[51] Int. Cl.[2] ..... A47B 5/00

[52] U.S. Cl. ..... 108/152; 108/110; 108/144; 211/128; 211/153; 211/190; 248/243

[58] Field of Search ..... 108/110, 152, 144; 211/134, 128, 135, 153, 190; 248/241, 242, 243, 247, 250

[56] References Cited

U.S. PATENT DOCUMENTS

| | | | |
|---|---|---|---|
| 768,295 | 8/1904 | Palfrey | 248/243 |
| 863,068 | 8/1907 | Huff et al. | 248/243 |
| 2,579,704 | 12/1951 | Saul | 108/110 X |
| 3,335,874 | 8/1967 | Levy et al. | 108/152 X |

*Primary Examiner*—James C. Mitchell

*Attorney, Agent, or Firm*—Norman S. Blodgett; Gerry A. Blodgett

[57] ABSTRACT

Wall fixture consisting of two parallel rails to which a shelf or the like is attached by means of inclined fins on the shelf engaging inclined slots on the rails.

10 Claims, 13 Drawing Figures

WALL FIXTURE

BACKGROUND OF THE INVENTION

It is common practice to apply appliances to a wall for both functional and decorative purposes. For this purpose, it is common practice to attach rails to the wall and to connect shelves to the rails by use of suitably formed fingers and apertures on the shelf and rail. Such shelf systems have always been both complex and expensive. Furthermore, they tend to have a mechanical appearance that does not lend itself to a pleasing decorative scheme. For an aesthetic point of view, once one has invested in a shelf system of this type, it is difficult to change the colors of the shelves or appliances. Also, the function of the prior art systems has been limited by the fact that it has not been practical to use them to support potted plants, because of the possibility of liquid running from the pot and dripping over the edge of the shelf. These and other difficulties experienced with the prior art devices have been obviated in a novel manner by the present invention.

It is, therefore, an outstanding object of the invention to provide a wall fixture which is inexpensive to manufacture and which, nevertheless, is capable of carrying substantial loads.

Another object of this invention is the provision of a wall fixture in which the appliance is manufactured from injection molded plastic and can be exchanged with an appliance of another color plastic with a minimum of expense and difficulty.

A further object of the present invention is the provision of a wall shelf which is relatively light in weight, yet which is capable of carrying substantial loads.

It is another object of the instant invention to provide a shelf for wall attachment which is particularly adapted to carry potted plants without damage to the shelf or of small amounts of water dripping from the edge and which can be readily cleaned.

With these and other objects in view, as will be apparent to those skilled in the art, the invention resides in the combination of parts set forth in the specification and covered by the claims appended hereto.

SUMMARY OF THE INVENTION

In general, the invention consists of a wall fixture having a pair of rails adapted to be mounted on a wall in spaced, parallel relationship, each rail being formed with a plurality of inclined slots. An appliance extends between the rails and has a main body with a surface facing the rails. Horizontally extending fins extend from the surface and lie in a slot of each of the rails.

More specifically, the shape of the slots and the cross-sectional shape of the fin are substantially the same. The main body and fin of the appliance are integrally formed of an injection-molded plastic. The appliance is a shelf formed by a wall of narrow rectangular shape and a wall of substantially wider rectangular shape joined at a right angle, each wall having at least one of the said fins.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
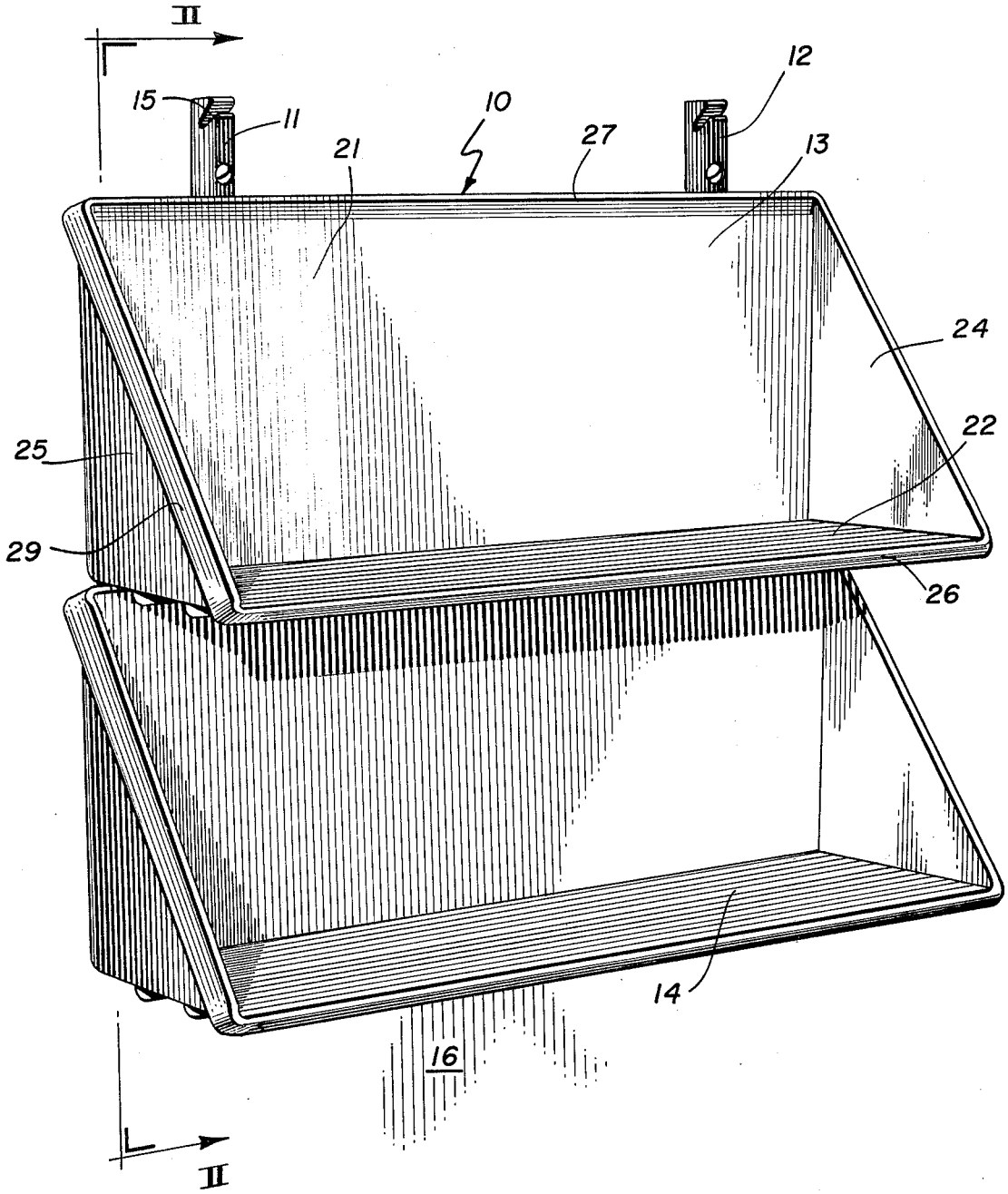
FIG. 1 is a perspective view of a wall appliance embodying the principles of the present invention.

Referring first to FIG. 1, wherein are best shown the general features of the invention, the wall fixture, indicated generally by the reference numeral 10, is shown as consisting of two rails 11 and 12 which are adapted to be mounted on a wall 16 in spaced, parallel relationship. Each rail is formed of an injection-molded plastic, such as high impact polystyrene, and is formed with a plurality of inclined slots 15.

Also, included in the wall fixture are appliances 13 and 14 which are exactly alike and are formed of an injection-molded plastic, such as high impact polystyrene. The appliance 13 is provided with a main body 17 having a rear surface 18 which faces the wall 16. From the surface 16 extend fins 19, each fin lying in a pair of slots 15, one in each of the two rails.

The shape of each of the slots 15 and the cross-sectional shape of each fin 19 are the same, so that they fit snugly together. In the preferred embodiment, the appliance 13 is a shelf whose main body 17 has a first vertical wall 21 and a second horizontal wall 22 which lie at a right angle to each other, each wall being provided with a plurality of the fins 19.

Figure 2:
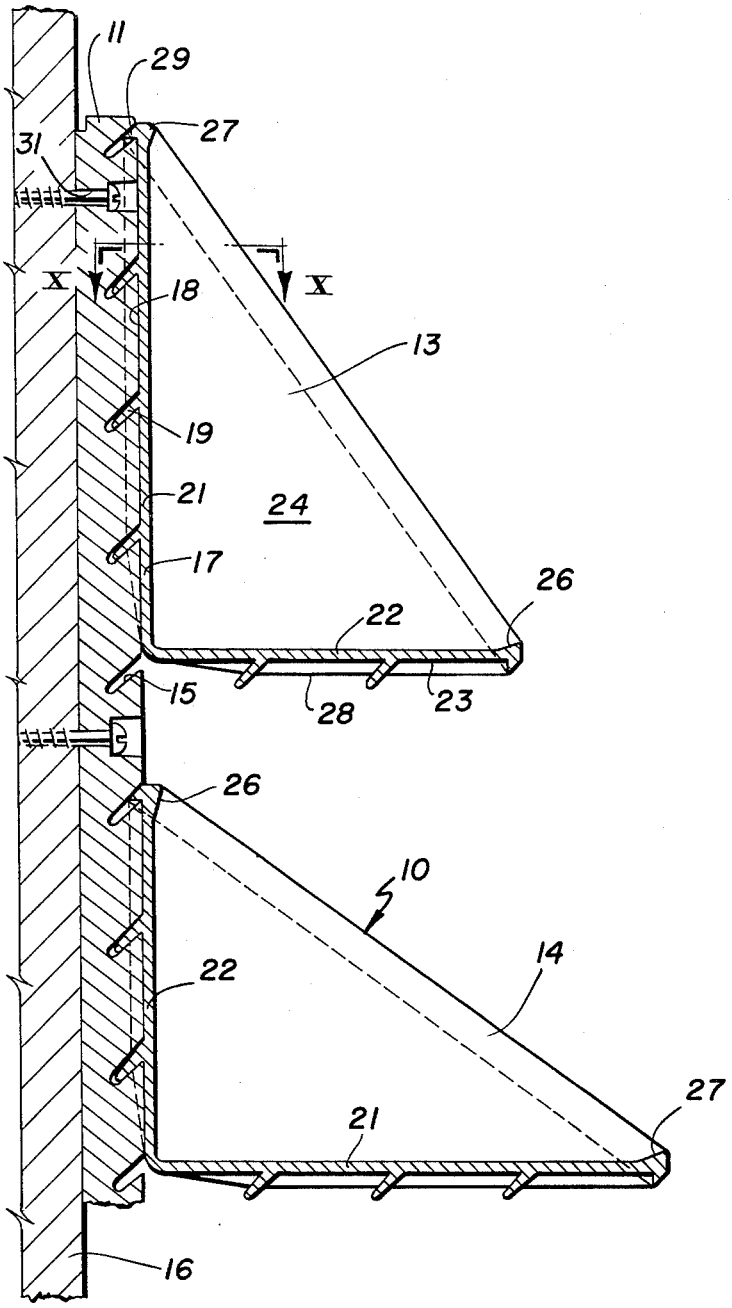
FIG. 2 is a vertical sectional view of the wall appliance taken on the line II—II of FIG. 1.
Figure 8:
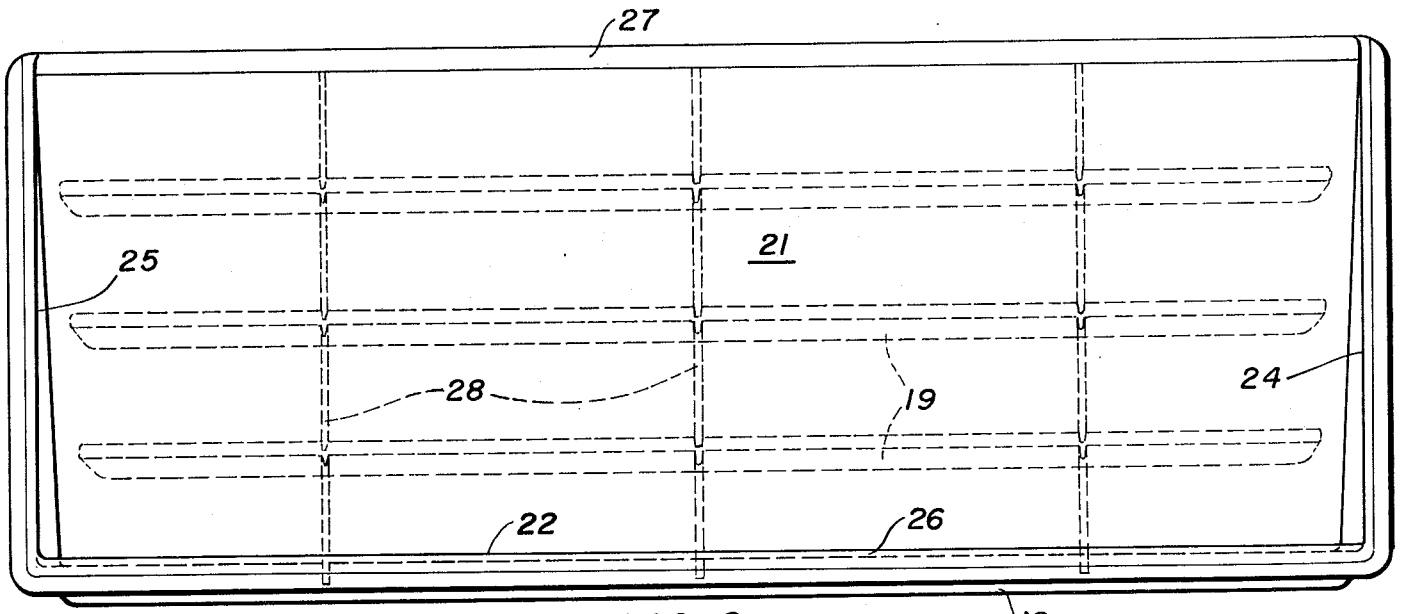
FIG. 8 is a front elevational view of a shelf forming part of the appliance.
Figure 9:
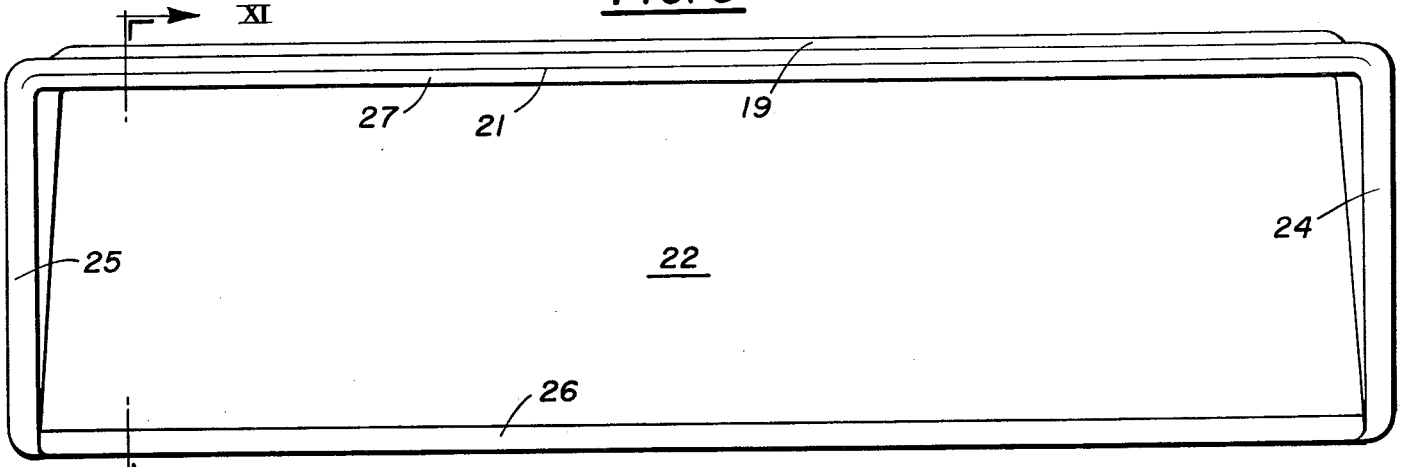
FIG. 9 is a top plan view of the shelf.
Figure 10:
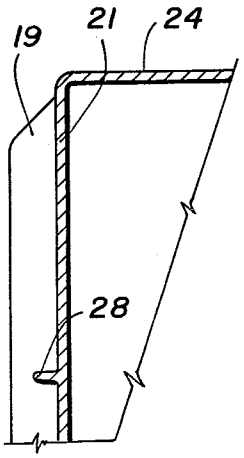
FIG. 10 is a sectional view of the shelf taken on the line X—X of FIG. 2.

Referring next to FIG. 2, it can be seen that each of the walls 21 and 22 have outwardly-directed surfaces (similar to the surface 18 of the wall 21) from which are directed fins 19. Each fin is directed at an acute angle to its wall and in all cases the fins 19 are directed toward the junction between the two walls 21 and 22. As is evident in FIGS. 8 and 9, the walls 21 and 22 are in the form of elongated rectangles, the walls being joined along long sides. Triangular end walls 24 and 25 join adjacent short or end sides of the rectangles. As is particularly evident in FIG. 2, the wall 21 is substantially wider than the wall 22.

Figure 12:
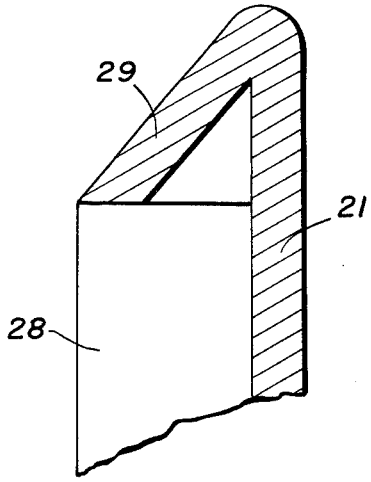
FIG. 12 is a sectional view of the invention taken on the line XII—XII of FIG. 11.
Figure 13:
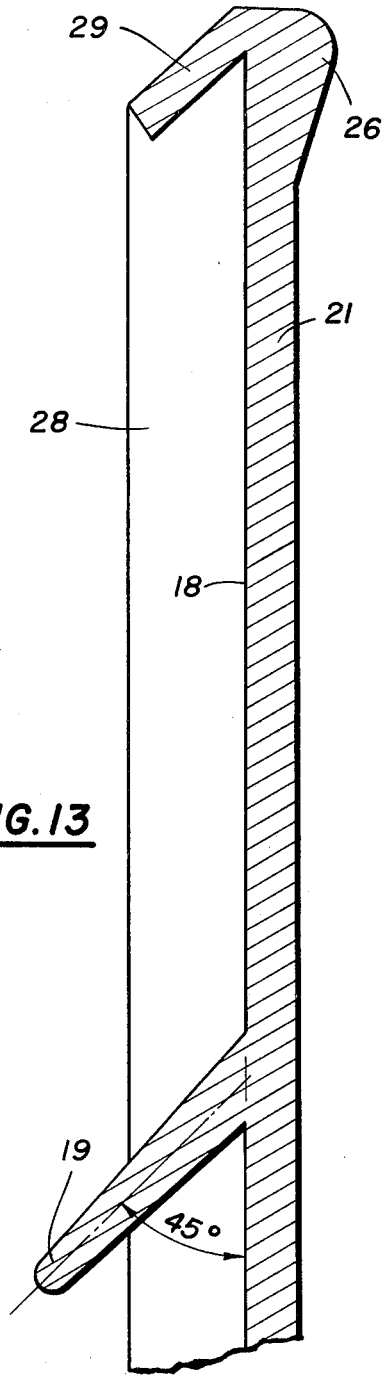
FIG. 13 is an enlarged view of a portion of the section shown in FIG. 11.
Figure 11:
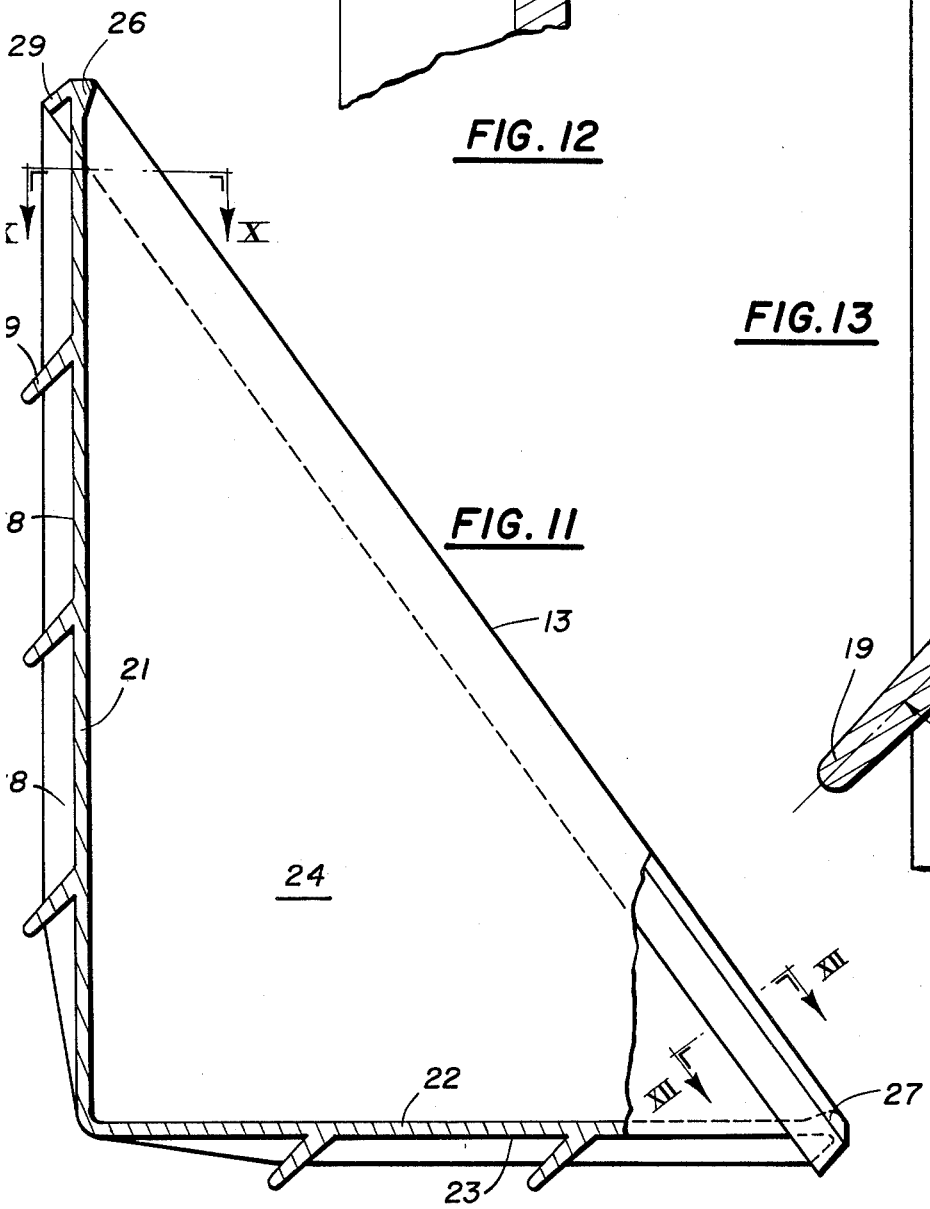
FIG. 11 is a vertical sectional view of the shelf taken on the line XI—XI of FIG. 9.

As is best evident in FIGS. 11 and 13, each of the fins 19 has a tapered cross-section with the larger portion located adjacent the wall from which it extends. The free edges of the shelf are provided with an outwardly-extending reinforcing flange 29. This flange extends around the entire periphery of the shelf, including the free edges of the triangular walls 24 and 25. Extending across the outer surfaces of the walls 21 and 22 in a direction transverse of its rectangular shape (and therfore in a direction perpendicular to the fins 19) are reinforcing ribs 28. As is evident in FIGS. 12 and 13, the ribs 28 extend outwardly from their respective walls the same distance as the reinforcing flange 29, the angle of the reinforcing flange incidentally being the same as that of the fins 19, i.e., 45° so that it is possible to draw the appliance 13 from the mold in which it is formed. The edges of the walls 21 and 22 which are remote from the junction between them are provided with an inwardly-directed lip 26 and 27, respectively. This lip is best shown in FIG. 13 and consists of a smoothly rounded ridge.

Figure 3:
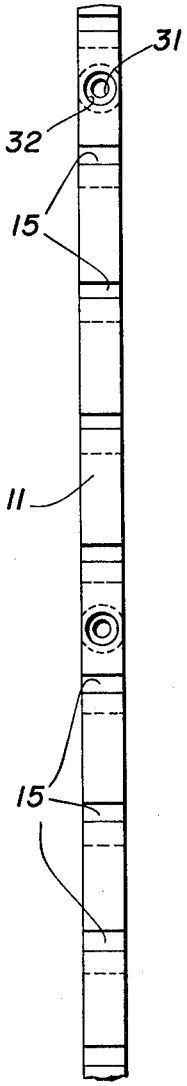
FIG. 3 is a front elevational view of a rail forming part of the appliance.
Figure 6:
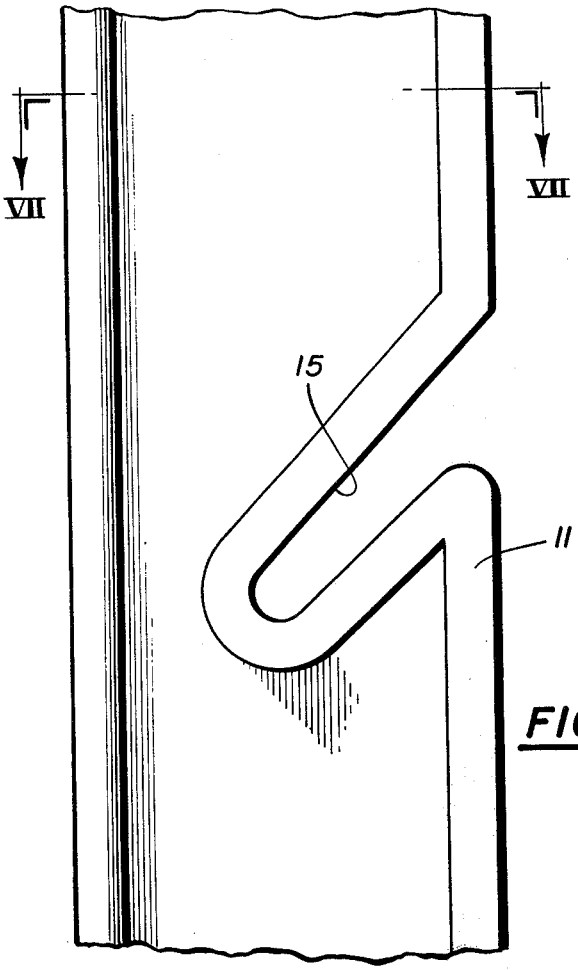
FIG. 6 is an enlarged view of a portion of the rail.
Figure 4:
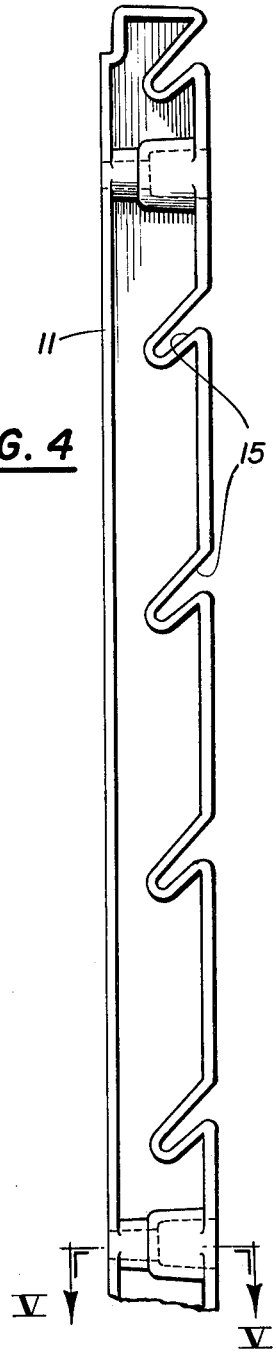
FIG. 4 is a side elevational view of the upper portion of the rail.
Figure 7:
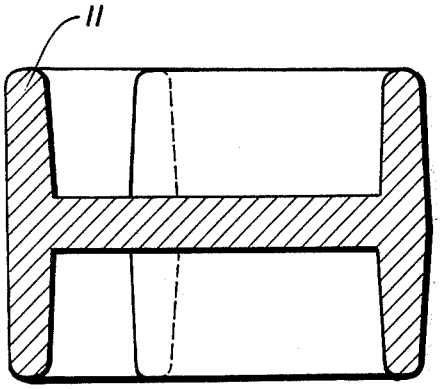
FIG. 7 is a horizontal sectional view of the rail, taken on line VII—VII of FIG. 6.
Figure 5:
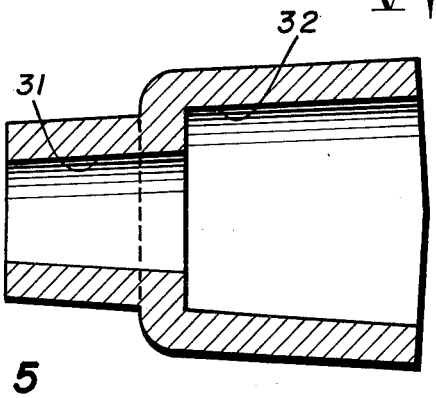
FIG. 5 is a horizontal cross-sectional view of the rail taken on the line V—V of FIG. 4.

FIGS. 2 and 3 show that the rail 11 is provided with at least two screw holes; the details of one of the screw holes is shown in FIG. 5. A screw hole 31 is shown as having a counter bore 32, so that the screw which fastens a rail to the wall 16 is completely hidden. As shown in FIG. 7 each rail is of I-beam construction and this is accomplished by providing flanges around the entire periphery of the rail as is best evident in FIG. 4. Each slot 15 is surrounded with its own flanges to provide for a broad gripping surface. The area occupied by the screw holes 31 and the counterbores 32 is also an enlarged portion of the rail.

The operation of the invention will now be readily understood in view of the above description and particularly with reference to FIG. 2. The rails 11 and 12 are fastened to the wall 16 by use of screws lying in the screw holes 31 with their heads lying in the counterbores 32. In the preferred embodiment at least two of these screw holes are provided for each rail. Each of the appliances or shelves 13 and 14 is placed on the rails by inserting its fins 19 into the slots 15 in the rails. As is evident in FIG. 3, in the case of the appliance 13, the wide wall 21 lies adjacent the wall 16 with its fins 19 locked in the slots 15. The other wall 22 extends at a right angle from it and constitutes the supporting surface of the shelf. In the case of the appliance 14, however, the short side is attached to the rails, while the long side extends outwardly to provide a substantially broader supporting shelf. The appliances 14 and 15 are, of course, exactly the same and the difference in aspect is brought about by reversing one of the appliances. If the wall 22 of the appliance 13 supports a potted plant, any water that may ooze from the bottom of the pot is prevented from running over the edge of the shelf by the presence of the lip 27. The locking inter-relationship between the reinforcing flange 28, the reinforcing ribs 27, and the fins 19, as well as the triangular end walls 24 make the appliance very strong and free of a tendency to bend or twist under load.

In addition to being extremely strong, so that much larger loads are permissible by the use of this shelf construction than would normally be permitted with wall attached shelves, the fact that the equipment is integrally formed from plastic means that it is free of dust-catching cracks and sharp angles. Furthermore, it can be washed in water in a manner similar to washing a dish. This is particularly important where potted plants are placed on the shelf and a certain amount of water and dirt emerge from the bottom of the pot. Furthermore, the fact that the shelves are inexpensively built from plastic means that a variety of colors are possible to any desired interior decorating scheme. The unusual construction of angled fins and angled slots on the rails means that the heavier the load, the more firmly the wall appliance is held together. The fact that the cross-section of each shelf is a triangle with one long leg and one short leg means that the shelf may be used either as a tall and narrow shelf (as in the case of shelf 13 in FIG. 2), or as a broad and low shelf (as in the case of shelf 14 in FIG. 2). As has been stated above, the lip 26 or 27 prevents wet material from potted plants from dripping over the edge of the shelf. When this construction is used, of course, the shelf has a built-in backing wall which not only prevents items mounted on the shelf from sliding off the back edge of the shelf (as is common in the prior wall mounted shelves), but also prevents the wallpaper on the wall from being damaged by whatever type of item is placed on the shelf.

It is obvious that minor changes be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Wall fixture, comprising:

a. a pair of rails adapted to be mounted on a wall in spaced, parallel relationship, each rail being formed with a plurality of inclined slots, and b. an appliance extending between the rails, the appliance having a main body with a surface facing the rails and having a horizontally-extending fin extending from the surface and lying in a slot of each of the rails, each of the fins having a tapered cross-sectional shape and being wider adjacent the wall from which it extends than at the portion more remote from the wall, the shape of the slots and the cross-sectional shape of the fin being substantially the same.

2. Wall fixture as recited in claim 1, wherein the main body and fin of the appliance are integrally formed of injection-molded plastic.

3. Wall fixture as recited in claim 1, wherein the appliance is a shelf whose main body has a first and a second wall extending at a right angle to each other, each wall being provided with a plurality of fins.

4. Wall fixture as recited in claim 3, wherein each wall has a flat, outwardly-directed surface, the fins on each surface being inclined at an acute angle to the surfaces and directed toward the junction between the walls.

5. Wall fixture as recited in claim 4, wherein each wall has the shape of an elongated rectangle, the walls being joined along long sides, and wherein a triangular end wall joins each set of adjacent short sides.

6. Wall fixture as recited in claim 5, wherein one wall has a substantially wider wall than the other.

7. Wall fixture as recited in claim 6, wherein the edges of the walls remote from the junction are provided with an inwardly-directed lip.

8. Wall fixture as recited in claim 7, wherein integral ribs extend from the outer surface of each wall and extend between fins.

9. Wall fixture as recited in claim 8, wherein an outwardly-directed reinforcing flange extends completely around the free edges of the walls.

10. Wall fixture, comprising:

a. a rail adapted to be mounted on a wall in vertical relationship, the rail being formed with a plurality of inclined slots, and b. an appliance attached to the rail, the appliance having a main body with a surface facing the rail and having horizontally-extending fins extending from the surface each fin lying in a slot of the rail, each of the fins having a tapered cross-sectional shape and being wider adjacent the wall from which it extends than at the portion more remote from the wall, the shape of the slots and the cross-sectional shape of the fin being substantially the same.

* * * * *